United States Patent [19]

Boulton

[11] Patent Number: 4,490,231

[45] Date of Patent: Dec. 25, 1984

[54] ELECTROLYTIC CELL OF THE FILTER PRESS TYPE

[75] Inventor: Thomas W. Boulton, Cheshire, England

[73] Assignee: Imperial Chemical Industries PLC, Hertfordshire, England

[21] Appl. No.: 440,854

[22] Filed: Nov. 12, 1982

[30] Foreign Application Priority Data

Nov. 24, 1981 [GB] United Kingdom ..... 8135403

[51] Int. Cl.[3] ..... C25B 9/00

[52] U.S. Cl. ..... 204/263; 204/266; 204/279

[58] Field of Search ..... 204/283, 253, 254, 255, 204/256, 257, 258, 279, 292, 263–266

[56] References Cited

U.S. PATENT DOCUMENTS 4,204,939 5/1980 Boulton et al. ..... 204/258
4,252,628 2/1981 Boulton et al. ..... 204/258
4,274,939 6/1981 Bjäreklint ..... 204/257
4,371,433 2/1983 Balko et al. ..... 204/279

FOREIGN PATENT DOCUMENTS 2027613 2/1980 United Kingdom ..... 204/253

*Primary Examiner*—R. L. Andrews
*Assistant Examiner*—Terryence Chapman
*Attorney, Agent, or Firm*—Cushman, Darby & Cushman

[57] ABSTRACT

A filter-press electrolytic cell comprising a plurality of metallic anode plates, metallic cathode plates, frame-like gaskets of an electrically insulating material, and hydraulically impermeable cation-exchange membranes, the anode plates, cathode plates and gaskets having four openings therein which in the cell form four compartments lengthwise of the cell from which liquors may be charged to the products of electrolysis may be removed from the anode and cathode compartments of the cell, at least some of the openings in the anode and cathode plates having electrically insulating frame-like members therein, which may be integral with the gaskets.

10 Claims, 6 Drawing Figures

ELECTROLYTIC CELL OF THE FILTER PRESS TYPE

This invention relates to an electrolytic cell of the filter press type, and in particular to an electrolytic cell which is suitable for use in the electrolysis of an aqueous solution of an alkali metal chloride.

Electrolytic cells are known comprising a plurality of anodes and cathodes with each anode being separated from the adjacent cathode by a substantially hydraulically impermeable cation-exchange membrane which divides the electrolytic cell into a plurality of anode and cathode compartments. The anode compartments of such a cell are provided with means for feeding electrolyte to the cell, suitably from a common header, and with means for removing products of electrolysis from the cell. Similarly, the cathode compartments of the cell are provided with means for removing products of electrolysis from the cell, and with means for feeding water or other fluid to the cell.

Electrolytic cells of the filter press type may comprise a large number of alternating anodes and cathodes, for example, fifty anodes alternatively with fifty cathodes, although the cell may comprise even more anodes and cathodes, for example up to one hundred and fifty alternating anodes and cathodes.

In such a membrane cell ionic species are transported across the membrane between the anode and cathode compartments of the cell. For example, where an aqueous alkali metal chloride solution is electrolysed in an electrolytic cell of the membrane type the solution is fed to the anode compartments of the cell and chlorine produced in the electrolysis and depleted alkali metal chloride solution are removed from the anode compartments, alkali metal ions are transported across the membranes to the cathode compartments of the cell to which water or dilute alkali metal hydroxide solution is charged, and hydrogen and alkali metal hydroxide solution produced by the reaction of alkali metal ions with water are removed from the cathode compartments of the cell.

A particular electrolytic cell of the filter press type is described in British Pat. No. 1595183. The cell comprises a plurality of vertically disposed flexible anode plates and flexible cathode plates and a cation permselective membrane positioned between each adjacent anode plate and cathode plate thereby forming separate anode compartments and cathode compartments. In the cell each anode plate is made in part of an electrically insulating material and comprises an anode portion formed of a film-forming metal having an electrocatalytically active coating on the surface thereof, each cathode plate is made in part of an electrically insulating material and comprises a metallic cathode portion, and a non-conducting flexible spacing plate which may act as a gasket is positioned between each membrane and adjacent anode plate and between each membrane and adjacent cathode plate. The anode plates, cathode plates and spacing plates each have openings which in the cell define four separate compartments lengthwise of the cell from which liquors may be charged respectively to the anode and cathode compartments of the cell and through which products of electrolysis may be removed from respectively the anode and cathode compartments of the cell. The spacing plates may be provided with channels in the walls thereof which provide the necessary connection for liquor flow between the compartments lengthwise of the cell and the anode and cathode compartments. In this electrolytic cell the anode plates and the cathode plates are formed in part of an electrically insulating material in order that those compartments lengthwise of the cell which are in communication with the anode compartments of the cell may be insulated electrically from those compartments lengthwise of the cell which are in communication with the cathode compartments of the cell. This electrical insulation is necessary to ensure that electrical current flows in the cell through the cation-exchange membranes positioned between adjacent anode plates and cathode plates.

In the aforementioned patent there is described a specific embodiment of anode plate and cathode plate, each of which is in part metallic and is in part made of an electrically insulating material. The anode plate and cathode plate each have a centrally positioned metallic electrode portion and four openings positioned near to the corners of the rectangularly shaped plate, two of the openings being defined by frame-like metallic portions of the plate integral with the plate, and two of the openings being defined by frame-like members made of an electrically insulating material positioned in the plane of the plate and in recesses in the plate near to corners of the plate.

Such a construction of anode plate and cathode plate is complicated and leads to problems of assembly into the electrolytic cell in that it is difficult to position the electrically insulating portions of the anode plates and cathode plates with the required accuracy. Furthermore, as the metallic and electrically insulating portions of the anode plate and of the cathode plate are not of unitary construction the metallic and electrically insulating parts must abut against each other. This abutment, which may extend over a substantial distance, may lead to problems of leakage of liquors from the anode and cathode compartments of the cell to the outside of the cell.

The present invention relates to an improvement of the electrolytic cell of the aforementioned patent which is of simplified construction and which is capable of being assembled more readily.

According to the present invention there is provided an electrolytic cell of the filter press type comprising a plurality of metallic anode plates and metallic cathode plates arranged in an alternating manner, a substantially hydraulically impermeable cation-exchange membrane and a frame-like gasket of an electrically insulating material positioned between each adjacent anode plate and cathode plate to form in the cell a plurality of separate anode compartments and cathode compartments, the anodes plates, cathodes plates and gaskets having four openings therein which in the cell together define four separate compartments lengthwise of the cell from which liquors may be charged respectively to the anode and cathode compartments of the cell and through which the products of electrolysis may be removed respectively from the anode and cathode compartments of the cell, characterised in that, in order to electrically insulate those compartments lengthwise of the cell from which liquors are charged to and through which products of electrolysis are removed from the anode compartments of the cell from those compartments lengthwise of the cell from which liquors are charged to and through which products of electrolysis are removed from the cathode compartments of the cell, there are positioned within and around the peripheries of at least some of the openings in the metallic anodes plates and cathode plates frame-like members of an electrically insulating material.

As explained hereinbefore it is essential that those compartments lengthwise of the cell which are in communication with the anode compartments of the cell are insulated electrically from those compartments lengthwise of the cell which are in communication with the cathode compartments of the cell. This electrical insulation is necessary to ensure that electrical current flows in the cell through the cation-exchange membranes positioned between adjacent anode plates and cathode plates. The frame-like members of electrically insulating material are positioned within and around the peripheries of at least some of the openings in the metalic anode plates and cathode plates in order to provide this necessary electrical insulation.

In each anode plate and each cathode plate all four of the openings may have positioned therein frame-like members of electrically insulating material.

Alternatively in order to provide the necessary electrical insulation the two openings in each of the anode plates which in the electrolytic cell form a part of the compartments lengthwise of the cell which communicate with the anode compartments of the cell may have frame-like members of electrically insulating material therein, and the two openings in each of the cathode plates which in the electrolytic cell form a part of the compartments lengthwise of the cell which communicate with the cathode compartments of the cell may have frame-like members of electrically insulating material therein.

Alternatively, the two openings in each of the anode plates which in the electrolytic cell form a part of the compartments lengthwise of the cell which are not in communication with the anode compartments of the cell may have frame-like members of electrically insulating material therein, and the two openings in the cathode plates which in the electrolytic cell form a part of the compartments lengthwise of the cell which are not in communication with the cathode compartments of the cell may have frame-like members of electrically insulating material therein.

The frame-like members of electrically insulating material should be flexible, and are desirably resilient. They should also have a thickness at least equal to the thickness of that part of the anode plate or cathode plate in which they are positioned. Indeed, they may have a thickness slightly greater than the thickness of that part of the anode plate or cathode plate in which they are positioned in order that in the assembled electrolytic cell they may be compressed, for example between gaskets, and thus effect a good seal.

In order to assist positioning of the frame-like members of electrically insulating material in the openings in the anode plates and cathode plates the outer peripheries of the frame-like members may have a shallow recess into which the edge of the opening in the anode plate or cathode plate may be fitted.

The electrolytic cell of the invention comprises a plurality of frame-like gaskets of electrically insulating material having four openings therein which in the cell form a part of the four compartments lengthwise of the cell. The four openings are located in the frame-like part of the gasket and the frame itself defines a central opening in the gasket. The openings are suitably disposed in pairs, one pair on one side of the central opening and the other pair on the opposite side of the central opening.

As in the case of the frame-like member of electrically insulating material the gasket should be flexible and is preferably resilient. Indeed they both may be made of the same material. Suitable materials include organic polymers, for example polyolefins, e.g. polyethylene and polypropylene, hydrocarbon elastomers, e.g. elastomers based on ethylene-propylene copolymers and ethylene-propylenediene copolymers, natural rubber and styrene-butadiene rubbers, and chlorinated hydrocarbons, e.g. polyvinyl chloride and polyvinylidene chloride. It is particularly desirable that material of the gasket and of the frame-like member of electrically insulating material be chemically resistant to the liquors in the electrolytic cell, and when the cell is to be used in the electrolysis of aqueous alkali metal chloride solution the material may be a fluorinated polymeric material, for example polytetrafluoroethylene, polyvinyl fluoride, polyvinylidene fluoride, or a tetra-fluoroethylene-hexa-fluoropropylene copolymer, or a substrate having an outer layer of such a fluorinated polymeric material.

In a preferred embodiment of the invention the frame-like members of electrically insulating material form a unit with a frame-like gasket. Thus, the frame-like members may be positioned on the surface of a gasket and be upstanding therefrom in the region of the openings in the frame-like part of the gasket. The frame-like members may be attached to the gasket, e.g. by an adhesive, or the frame-like members and the gasket may be of unitary construction, for example the gasket having frame-like members upstanding from the surface of the gasket may be produced in a suitably shaped mould.

There are two alternative forms of this preferred embodiment. The frame-like members upstanding from the surface of the gasket may have a thickness at least equal to the thickness of that part of the anode plate or cathode plate in which the frame-like members are positioned.

Alternatively, the thickness of the frame-like members upstanding from the surface of the gasket may be less than the thickness of that part of the anode plate or cathode plate in which the frame-like members are positioned, and gaskets may be positioned on opposite sides of the anode plate or cathode plate such that the frame-like members on the surfaces of both gaskets are positioned in and cooperate with each other in the openings in the anode plate or cathode plate and thus effect the desired electrical insulation.

This embodiment in which the frame-like members form a unit with the gasket is preferred as it enables correct positioning of the gaskets in relation to the anode plates and cathode plates to be facilitated, and eliminates the need for separate positioning of the frame-like members in the openings in the anode plates and cathode plates and thus further simplifies assembly of the electrolytic cell.

In the electrolytic cell there are provided means for feeding liquors to the anode and cathode compartments of the cell from the compartments lengthwise of the cell, and means for feeding the products of electrolysis from the anode and cathode compartments of the cell to the compartments lengthwise of the cell. These means may be provided by channels in the walls of the gaskets which provide passage-ways between the openings in the frame-like part of the gasket and the central opening defined by the frame-like part of the gasket. The channels may be provided by slots in the walls of the gaskets. The gaskets will have two channels in the walls thereof so arranged that the anode compartments of the cell are in communication with the compartments lengthwise of the cell from which liquors are fed to and products of electrolysis are removed from the anode compartments, and the cathode compartments of the cell are in communication with the compartments lengthwise of the cell from which liquors are charged to and products of electrolysis are removed from the cathode compartments.

The nature of the metal of the metallic anode plate will depend on the nature of the electrolyte to be electrolysed in the electrolytic cell. A preferred metal is a film-forming metal, particularly where an aqueous solution of an alkali metal chloride is to be electrolysed in the cell.

The film-forming metal may be one of the metals titanium, zirconium, niobium, tantalum or tungsten or an alloy consisting principally of one or more of these metals and having anodic polarisation properties which are comparable with those of the pure metal. It is preferred to use titanium alone, or an alloy based on titanium and having polarisation properties comparable with those of titanium.

The anode plate will have a central anode portion and the openings in the plate may be disposed near the edges of the plate in positions corresponding to the positions of the openings in the frame-like gasket. The openings are preferably disposed in pairs, one pair on one side of the anode portion and one pair on the opposite side of the anode portion.

The anode portion may comprise a plurality of elongated members, which are preferably vertically disposed, for example in the form of louvres or strips, or it may comprise a foraminate surface such as mesh, expanded metal or perforated surface. The anode portion may comprise a pair of foraminate surfaces disposed substantially parallel to each other.

The anode portion of the anode plate may carry a coating of an electroconducting electrocatalytically active material. Particularly in the case where an aqueous solution of an alkali metal chloride is to be electrolysed this coating may for example consist of one or more platinum group metals, that is platinum, rhodium, iridium, ruthenium, osmium and palladium, or alloys of the said metals, and/or an oxide or oxides thereof. The coating may consist of one or more of the platinum group metals and/or oxides thereof in admixture with one or more non-noble metal oxides, particularly a film-forming metal oxide. Especially suitable electrocatalytically active coatings include platinum itself and those based on ruthenium dioxide/titanium dioxide and ruthenium dioxide/tin dioxide/titanium dioxide.

Such coatings, and methods of application thereof, are well known in the art.

The nature of the metal of the metallic cathode plate will also depend on the nature of the electrolyte to be electrolysed in the electrolytic cell. Where an aqueous solution of an alkali metal chloride is to be electrolysed the metal of the cathode may for example be steel, e.g. mild steel or stainless steel, or nickel, or nickel coated steel. Other metals may be used. The cathode plate will have a central cathode portion and the openings in the plate may be disposed near the edges of the plate in positions corresponding to the position of the openings in the frame-like gasket. The openings are preferably disposed in pairs, one pair on one side of the cathode portion and one pair on the opposite side of the cathode portion.

The cathode portion may comprise a plurality of elongated members, which are preferably vertically disposed, for example in the form of louvres or strips, or it may comprise a foraminate surface such as mesh, expanded metal or perforated surface. The cathode portion may comprise a pair of foraminate surfaces disposed substantially parallel to each other.

The cathode portion of the cathode plate may carry a coating of a material which reduces the hydrogen overvoltage at the cathode when the electrolytic cell is used in the electrolysis of aqueous alkali metal chloride solution. Such coatings are known in the art.

The anode plates and cathode plates are provided with means for attachment to a power source. For example, they may be provided with extensions which are suitable for attachment to appropriate bus-bars.

It is desirable that both the anode plates and cathode plates are flexible, and preferably that they are resilient, as flexibility and resiliency assists in the production of leak-tight seals when the plates are assembled into an electrolytic cell.

The thickness of the anode plates and cathode plates, at least in the region of the opening therein, is suitably in the range 0.5 mm to 3 mm.

It is preferred that the dimensions of the anode and cathode plates in the direction of current flow are such as to provide short current paths which in turn ensure low voltage drops in the anode and cathode plates without the use of elaborate current carrying devices. A preferred dimension in the direction of current flow is in the range of 15 to 60 cm.

The cation-exchange membrane in the electrolytic cell of the invention may have external dimensions substantially the same as those of the anode plates, cathode plates and gaskets, in which case the membrane will have four openings therein corresponding in position to the openings in the anode and cathode plates and the gaskets. Alternatively, the membrane may have external dimensions less than those of the anode and cathode plates and the gaskets in which case the membrane will not be provided with openings therein, and in the electrolytic cell it may be positioned, for example, between a pair of gaskets in such a position as not to overlap the openings in the frames of the gaskets.

The nature of the cation-exchange membrane will depend on the electrolyte which is to be electrolysed in the cell. The membrane should be resistant to degradation by the electrolyte and by the products of electrolysis and, where an aqueous solution of alkali metal chloride is to be electrolysed, the membrane is suitably made of a fluorine-containing polymeric material containing cation-exchange groups, for example, sulphonic acid, carboxylic acid or phosphonic acid groups, or derivatives thereof, or a mixture of two or more such groups.

Such cation-exchange membranes are well known in the art. Suitable cation-exchange membranes are those described, for example in UK Pat. Nos. 1184321, 1402920, 14006673, 1455070, 1497748, 1497749, 1518387 and 1531068.

The electrolytic cell will be provided with end plates which may be respectively a terminal anode plate and a terminal cathode plate.

The electrolytic cell may be provided with up to 50 or more anode plates alternating with up to 50 or more cathode plates, with a gasket or gaskets and a cation-exchange membrane positioned between adjacent anode plates and cathode plates.

The compartments lengthwise of the cell which are formed by the openings in the anode plates, the cathode plates, and in the frame-like part of the gaskets may be connected to suitable headers from which liquors may be charged to the lengthwise compartments and thence to the anode and cathode compartments of the cell, and to which the products of the electrolysis may be fed from the anode and cathode compartments via the compartments lengthwise of the cell.

The electrolytic cell of the invention may be used in the electrolysis of different electrolytes. However, it is particularly suitable for use in the electrolysis of an aqueous alkali metal chloride solution, e.g. sodium chloride solution. In electrolysing sodium chloride solution the solution is charged to one of the compartments lengthwise of the cell and is passed, for example via channels, for example in the walls of the gaskets, into the anode compartments of the cell. Chlorine gas produced in the electrolysis, together with dilute sodium chloride solution is passed from the anode compartments, for example via channels in the walls of the gaskets, to a different compartment lengthwise of the cell. Water or dilute aqueous sodium hydroxide solution is charged to a compartment lengthwise of the cell and is passed, for example via channels in the walls of the gaskets, into the cathode compartments of the cell. Hydrogen and concentrated sodium hydroxide solution produced in the electrolysis is passed from the cathode compartments, for example via channels in the walls of the gaskets, to a different compartment lengthwise of the cell.

BRIEF DESCRIPTION OF THE DRAWINGS

The invention will now be described by reference to the following drawings.

DESCRIPTION OF THE PREFERRED EMBODIMENT

Figure 1:
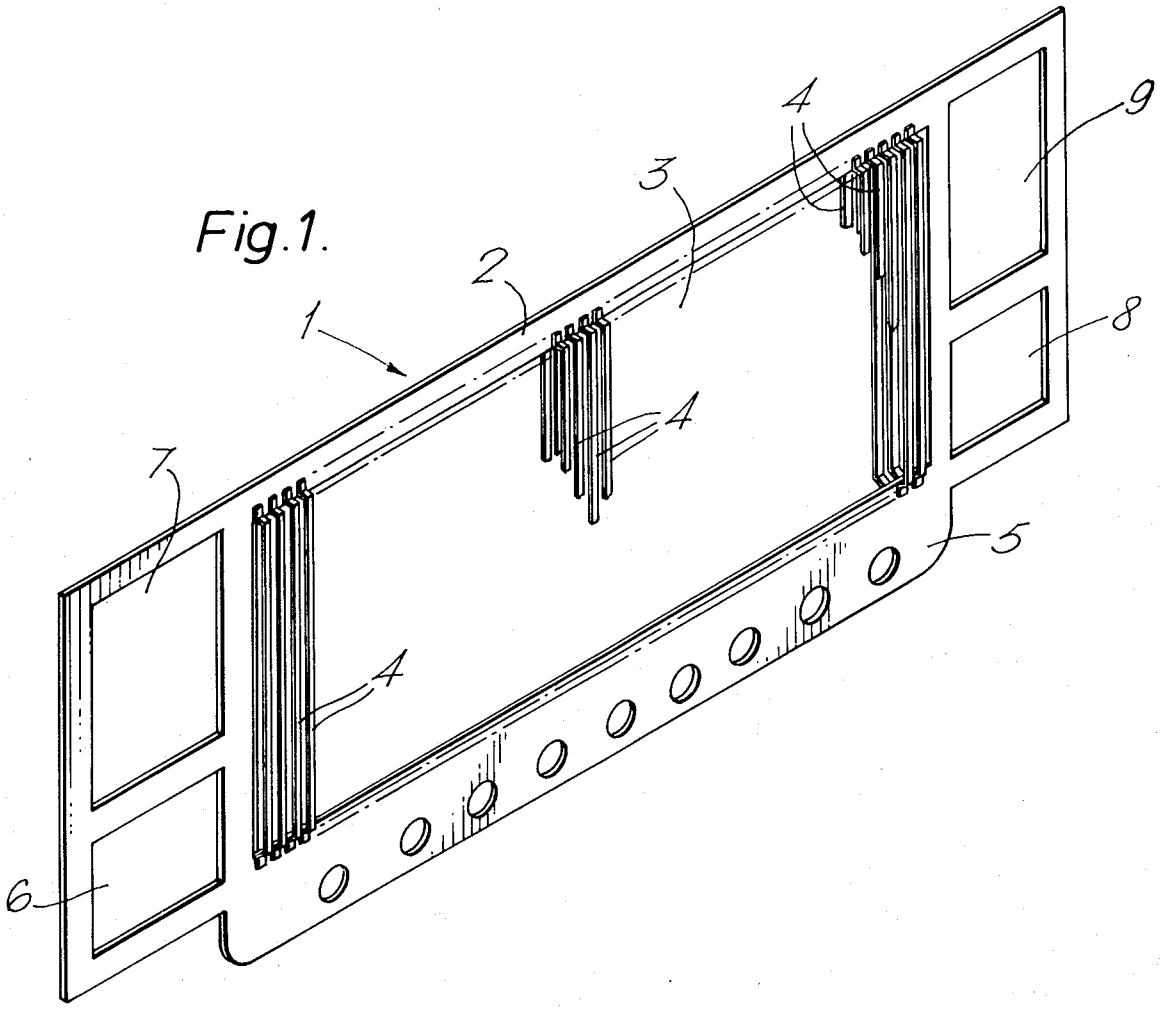
FIG. 1 is an isometric view of an electrode for use in the electrolytic cell of the invention.

Referring to FIG. 1 the metallic electrode (1) comprises a frame-like member (2) which defines a central opening (3). The central opening (3) is bridged by a plurality of vertically disposed strips (4) which are attached to the upper and lower parts of the frame-like member and are parallel to and displaced from the plane of the frame-like member. The strips are positioned on both sides of the frame-like member (2). The strips are so positioned that a strip on one side is positioned opposite the gap between two adjacent strips on the other side.

The metallic electrode (1) has a projection (5) onto which a suitable electrical connection may be fixed. Where the electrode (1) is to be used as an anode the projection (5) is positioned on the lower edge of the frame-like member (2) and where the electrode (1) is to be used as a cathode the projection (5) is positioned on the opposite upper edge of the frame-like member (2). The frame-like member (2) comprises a pair of openings (6,7) positioned to one side of the central opening (3) and a pair of openings (8,9) positioned to the opposite side of the central opening (3). When the electrode is installed in an electrolytic cell these openings form a part of compartments lengthwise of the cell through which electrolyte and other fluid may be charged to the anode and cathode compartments of the cell and through which the products of electrolysis may be removed from the anode and cathode compartments of the cell. The metal of the electrode will be chosen depending on whether it is to be used as an anode or a cathode and on the nature of the electrolyte to be used in the electrolytic cell.

Figure 2:
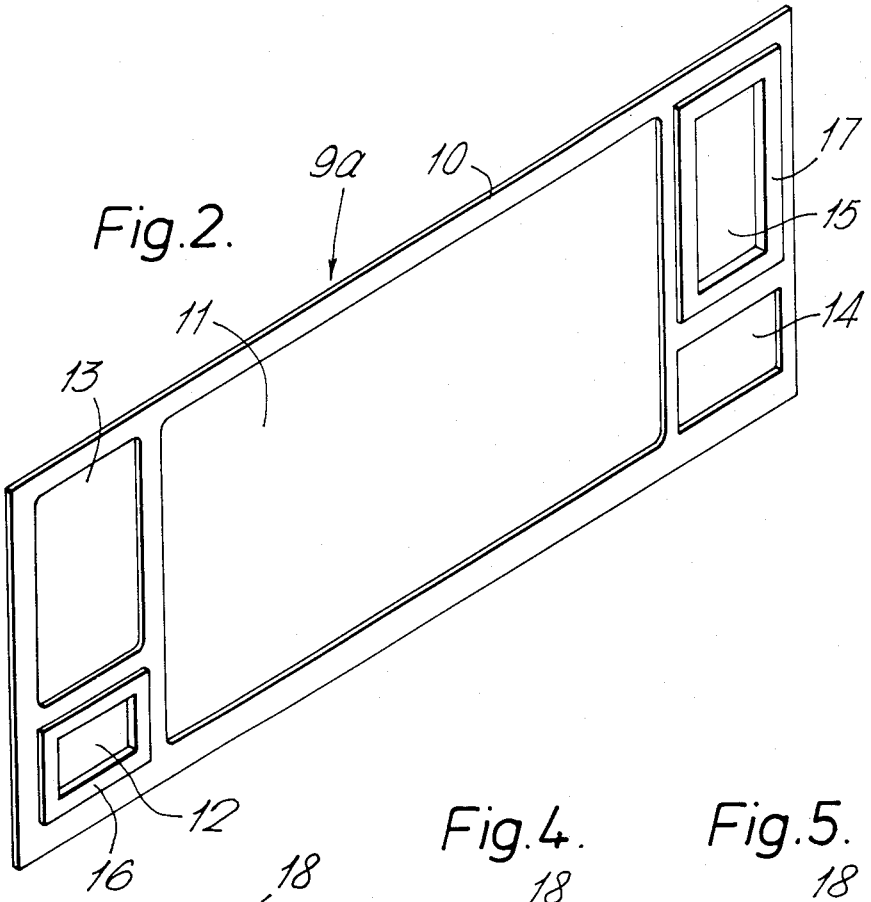
FIG. 2 is an isometric view of a frame-like gasket comprising frame-like members of electrically insulating material.

Referring to FIG. 2 the gasket (**9*a*) comprises a frame-like part (10) which defines a central opening (11). The frame-like part (10) comprises a pair of openings (12,13) positioned to one side of the central opening (11) and a pair of openings (14,15) positioned to the opposite side of the central opening (11). When the gasket is installed in an electrolytic cell these openings form a part of compartments lengthwise of the cell through which electrolyte and other fluid may be charged to the anode and cathode compartments of the cell and through which the products of electrolysis may be removed from the anode and cathode compartments of the cell. The openings (12,15) also have upstanding frame-like members (16,17) positioned around the openings and projecting from the plane of the frame-like gasket and which are adapted to fit into the openings (6,9) respectively of the metallic electrode when assembled into the electrolytic cell. The upstanding frame-like members (16,17) provide the required electrical insulation in the electrolytic cell between the compartments lengthwise of the cell formed in part by openings (6,7,8,9) in the electrode. The upstanding frame-like members (16,17) are of unitary construction with the gasket (9*a*) and may be produced, for example, by moulding a suitable electrically insulating thermoplastic polymeric material. Where the electrolytic cell comprises gaskets of the type illustrated in FIG. 2 it will also comprise similar gaskets in which the upstanding frame-like members (16,17) are positioned around the openings (14,13**) of the gasket.

Figure 3:
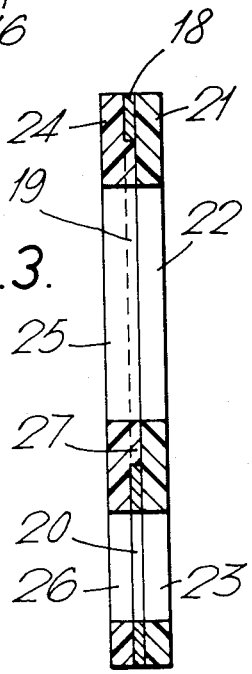
FIG. 3 is an end sectional view in elevation of an electrode and a pair of gaskets one of which comprises frame-like members of electrically insulating material.

FIG. 3 illustrates the assembly of an electrode and a pair of gaskets into the electrolytic cell. The assembly comprises an electrode (18) comprising four openings (19,20, two not shown), a frame-like gasket (21) comprising four openings (22,23, two not shown), and a second frame-like gasket (24) comprising four openings (25,26, two not shown). The frame-like gasket (24) comprises two upstanding frame-like members (27, one not shown) projecting from the plane of the gasket (24) and positioned in the openings (19, one not shown) of the electrode (18) and in register with the surface of the gasket (21) to form a leak tight seal. In the assembly of FIG. 3 the projection on the electrode (see (5) of FIG. 1) for electrical connection has been omitted.

FIG. (4) illustrates an alternative assembly of an electrode and a pair of gaskets into the electrolytic cell. As in the case of FIG. 3 the assembly comprises an electrode (18) comprising four openings (19,20, two not shown). The assembly comprises a frame-like gasket (28) comprising four openings (29,30, two not shown)

and two upstanding frame-like members (31, one not shown) projecting from the plane of the gasket (28) and positioned in the openings (19, one not shown) of the electrode (18). The assembly also comprises a second frame-like gasket (32) comprising four openings (33, 34, two not shown) and two upstanding frame-like members (35, one not shown) projecting from the plane of the gasket (32) and positioned in the openings (19, one not shown) of the electrode (18). In the assembly the upstanding frame-like members (31,35) projecting from the plane of the gaskets (28,32) are in register with each other to form a leak-tight seal.

Figure 4:
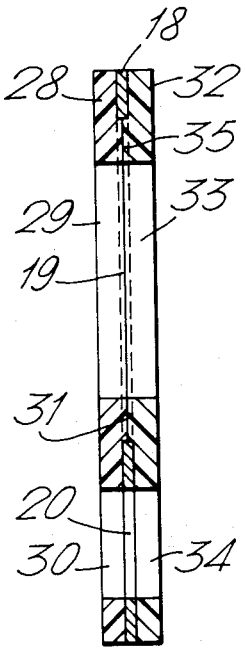
FIGS. 4 and 5 are end sectional views in elevation of an electrode and a pair of gaskets each of which comprises frame-lke members of electrically insulating material.
Figure 5:
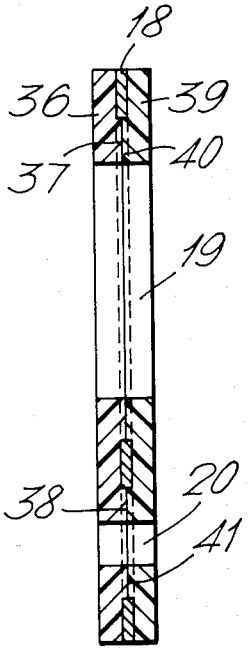

FIG. 5 shows a modification of the embodiment of FIG. 4 in which the frame-like gasket (36) comprises four upstanding frame-like members (37, 38, two not shown) projecting from the plane of the gasket (36) and in which the frame-like gasket (39) comprises four upstanding frame-like members (40,41, two not shown) projecting from the plane of the gasket (39). In this embodiment upstanding frame-like members projecting from the surfaces of the gaskets are positioned in all four openings in the electrode which form a part of the compartments lengthwise of the cell.

Figure 6:
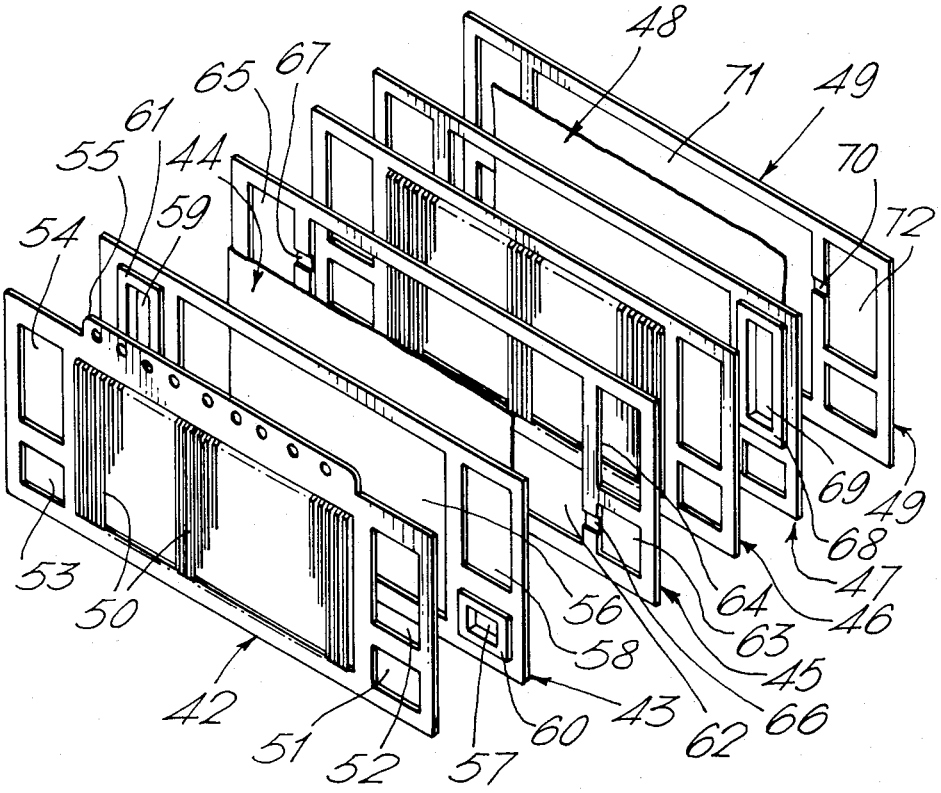
FIG. 6 is an isometric exploded view of a part of an electrolytic cell of the invention.

The embodiment of FIG. 6 shows a part of an electrolytic cell of the invention and comprises a cathode (42) a gasket (43), a cation-exchange membrane (44), a gasket (45), an anode (46) a gasket (47), a cation-exchange membrane (48) and a gasket (49). The cathode (42) comprises a plurality of vertically disposed strips (50) positioned on both sides of the cathode and four openings (51,52,53,54) and a projection (55) suitable for electrical connection. The gasket (43) comprises a central opening (56) and four openings (57,58,59 one not shown and two upstanding frame-like members (60,61) projecting from the plane of the surface of the gasket. The gasket (45) is a plane gasket and comprises a central opening (62), four openings (63,64,65, one not shown), and also two channels (66,67) in the walls of the gasket which provide communicating channels between the central opening (62) and the openings (63,65) respectively). The anode (46) is of similar construction to the cathode (42) except that the projection for electrical connection is positioned on the lower edge of the anode and is not shown. The gasket (47) is of similar construction to the gasket (43) except that the upstanding frame-like members (68, one not shown) projecting from the plane of the surface of the gasket are positioned around openings (69 one not shown) in the gasket (47) different in position from those in the gasket (43) around which frame-like members are positioned. The gasket (49) is of similar construction to gasket (45) except that in gasket (49) the channels (70, one not shown) in the walls of the gasket provide communicating channels between the central opening (71) and openings in the gasket (72, one not shown) different in position from those in the gasket (45) which are in communication with the central opening (62) in the gasket (45).

In the electrolytic cell the gaskets (45) and (47) and the anode (46) together form an anode compartment of the cell, the compartment being bounded by the cation-exchange membranes (44,48). Similarly, the cathode compartments of the cell are formed by the cathode (42), gasket (43), and a gasket (not shown) of the type of (49) positioned adjacent to the cathode (42), the cathode compartment also being bounded by two cation-exchange membranes. In the assembled cell the cation-exchange membranes are held in position by gaskets positioned on either side of each membrane. For the sake of clarity the embodiment of FIG. 6 does not show end plates for the cell which of course form a part of the cell, nor the means, e.g bolts, which are provided in order to fasten together the electrodes and gaskets in a leak tight assembly. The cell comprises a plurality of anodes and cathodes as hereinbefore described. The cell also comprises headers (not shown) from which electrolyte may be charged to the compartment lengthwise of the cell of which opening (51) of the cathode (42) forms a part and thence via a channel (66) in the wall of the gasket (45) to the anode compartment of the cell, and to which products of electrolysis may be passed from the anode compartments of the cell via channel (67) in the wall of the gasket (45) and via the compartment lengthwise of the cell of which the opening (54) in the cathode (42) forms a part. Similarly, the cell also comprises headers (not shown) from which liquid, e.g. water, may be charged to the compartment lengthwise of the cell of which opening (53) in the cathode (42) forms a part and thence via a channel (not shown) in the wall of the gasket (49) to the cathode compartment of the cell, and to which products of electrolysis may be passed from the cathode compartments of the cell via channel (70) in the wall of the gasket (49) and via the compartment lengthwise of the cell of which the opening (52) in the cathode (42) forms a part.

I claim:

1. An electrolytic cell of the filter press type comprising a plurality of metallic anode plates and metallic cathode plates arranged in an alternating manner, a substantially hydrualically impermeable cation-exchange membrane and a frame-like gasket of an electrically insulating material positioned between each adjacent anode plate and cathode plate to form in the cell a plurality of separate anode compartments and cathode compartments, the anodes plates, cathode plates and gaskets having four opening therein which in the cell together define four separate compartments lengthwise of the cell from which liquors may be charged respectively to the anode and cathode compartments of the cell and through which the products of electrolysis may be removed respectively from the anode and cathode compartments of the cell, characterised in that, in order to electrically insulate those comartments lengthwise of the cell from which liquors are charged to and through which products of electrolysis are removed from the anode compartments of the cell from those compartments lengthwise of the cell from which liquors are charged to and through which products of electrolysis are removed from the cathode compartments of the cell, there are positioned within and around the peripheries of at least some of the openings in the metallic anodes plates and cathode plates frame-like members of an electrically insulating material, said frame-like members being positioned on and being upstanding from the surface of said gasket.

2. An electrolytic cell as claimed in claim 1 characterised in that the four openings in each anode plate and each cathode plate each have a frame-like member of an electrically insulating material positioned therein.

3. An electrolytic cell as claimed in claim 1 characterised in that the two openings in each of the anode plates which in the electrolytic cell form a part of the compartments lengthwise of the cell which communicate with the anode compartments of the cell have frame-like members of electrically insulating material positioned therein, and in that the two openings in each of the cathode plates which in the electrolytic cell form a part of the compartments lengthwise of the cell which communicate with the cathode compartments of the cell have frame-like members of electrically insulating material positioned therein.

4. An electrolytic cell as claimed in claim 1 characterised in that the two openings in each of the anode plates which in the electrolytic cell form a part of the compartments lengthwise of the cell which are not in communication with the anode compartments of the cell have frame-like members of electrically insulating material positioned therein, and in that the two openings in the cathode plates which in the electrolytic cell form a part of the compartments lengthwise of the cell which are not in communication with the cathode compartments of the cell have frame-like members of electrically insulating material positioned therein.

5. An electrolytic cell as claimed in claim 1 characterised in that the frame-like members of electrically insulating material are resilient.

6. An electrolytic cell as claimed in claim 1 characterised in that the four openings in the gasket which in the electrolytic cell form a part of the compartments lengthwise of the cell are disposed in pairs on opposite sides of a central opening in the gasket.

7. An electrolytic cell as claimed in claim 1 characterised in that the gasket is resilient.

8. An electrolytic cell as claimed in claim 1 characterised in that the frame-like members are upstanding from the surface of the gasket and are of unitary construction.

9. An electrolytic cell as claimed in claim 8 characterised in that the frame-like members upstanding from the surface of the gasket have a thickness at least equal to the thickness of that part of the anode plate or cathode plate in which the frame-like members are positioned.

10. An electrolytic cell as claimed in claim 8 characterised in that the thickness of the frame-like members upstanding from the surface of the gasket is less than the thickness of that part of the anode plate or cathode plate in which the frame-like members are positioned, and in that gaskets are positioned on opposite sides of the anode plate or cathode plate such that the frame-like members on the surfaces of both gaskets are positioned in and cooperate with each other in the openings in the anode plate or cathode plate.

* * * * *